US007658284B2

(12) United States Patent
Lin

(10) Patent No.: US 7,658,284 B2
(45) Date of Patent: Feb. 9, 2010

(54) SLEEVE RETAINING ASSEMBLY

(76) Inventor: Tsung-Da Lin, 235 Chung-Ho Box 8-24, Taipei (TW)

( * ) Notice: Subject to any disclaimer, the term of this patent is extended or adjusted under 35 U.S.C. 154(b) by 272 days.

(21) Appl. No.: 11/770,703

(22) Filed: Jun. 28, 2007

(65) Prior Publication Data

US 2009/0001111 A1 Jan. 1, 2009

(51) Int. Cl.
*B65D 85/28* (2006.01)

(52) U.S. Cl. ..... 206/378; 221/70.6

(58) Field of Classification Search ..... 206/373, 206/378, 349, 372, 379, 376, 377, 493; 211/70.6; 248/314

See application file for complete search history.

(56) References Cited

U.S. PATENT DOCUMENTS 5,862,913 A * 1/1999 Chou ..... 206/378
6,415,933 B1 * 7/2002 Kao ..... 211/70.6
6,450,338 B1 * 9/2002 Chen ..... 206/378
6,854,607 B2 * 2/2005 Tong ..... 211/70.6

* cited by examiner

*Primary Examiner*—Ehud Gartenberg
*Assistant Examiner*—Blaine G Neway
(74) *Attorney, Agent, or Firm*—Egbert Law Offices PLLC

(57) ABSTRACT

A socket retaining assembly includes a retaining assembly having a seat, and a retaining post; the retaining post being installed at an upper end of the stopper; an outer periphery of the retaining post being installed with a confining projection and a plurality of trenches; a combination unit including a rotating assembly and a push unit; the stopper serving to confine the rotation range of the combination unit; the rotating assembly has a C ring at a lower end thereof two ends of an opening of the C ring being concaved inwards so as to form with inward projections; an upper side of the C ring being installed with a rectangular protruding block; an interior of the protruding block being formed with a rectangular receiving groove; and the push unit being installed in the receiving groove of the protruding block.

8 Claims, 3 Drawing Sheets

SLEEVE RETAINING ASSEMBLY

FIELD OF THE INVENTION

The present invention relates to sockets, and in particular to a socket retaining assembly which has a plurality of connecting ends for retaining sockets. The detaching and installing to the sockets are very easily and conveniently only by rotating the socket aside.

BACKGROUND OF THE INVENTION

In the current design of socket spanner, a driving head of the spanner can be engaged with a plurality of sockets so as to expand the use of the spanner. Thus there is a demand for storing the sockets with a convenient and easy way.

In the prior art way for retaining the sockets, a retaining assembly is used for retaining a plurality of sockets. The retaining assembly has a plurality of holes. A pin is used to pass through the socket and then is retained to the holes of the retaining assembly.

However, above mentioned way is not convenient in operation for installing and detaching the socket from the retaining assembly. Furthermore the holes are formed as an array, while the arrangement of the retaining assembly.

SUMMARY OF THE INVENTION

Accordingly, the primary object of the present invention is to provide a socket retaining assembly which has a plurality of connecting ends for retaining sockets. The detaching and installing to the sockets are very easily and conveniently only by rotating the socket aside.

To achieve above objects, the present invention provides a socket retaining assembly, comprising:

a retaining assembly having a seat, and a retaining post;

the seat being a long U shape structure; a stopper being protruded from an upper middle section of the seat; the stopper being a long plate;

the retaining post being installed at an upper end of the stopper; an outer periphery of the retaining post being installed with a confining projection and a plurality of trenches;

a combination unit including a rotating assembly and a push unit; the stopper serving to confine the rotation range of the combination unit;

the rotating assembly has a C ring at a lower end thereof; two ends of an opening of the C ring being concaved inwards so as to form with inward projections; in operation, the inward projections being received in the trenches of the retaining post and being slideably through various trenches so as to adjust the combination unit to have different orientation; the movement of the combination unit being confined by the confining projection; an upper side of the C ring being installed with a rectangular protruding block; an interior of the protruding block being formed with a rectangular receiving groove;

the push unit being installed in the receiving groove of the protruding block;

wherein when the combination unit rotates in the retaining assembly, the push unit will resist against the trenches of the retaining post.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
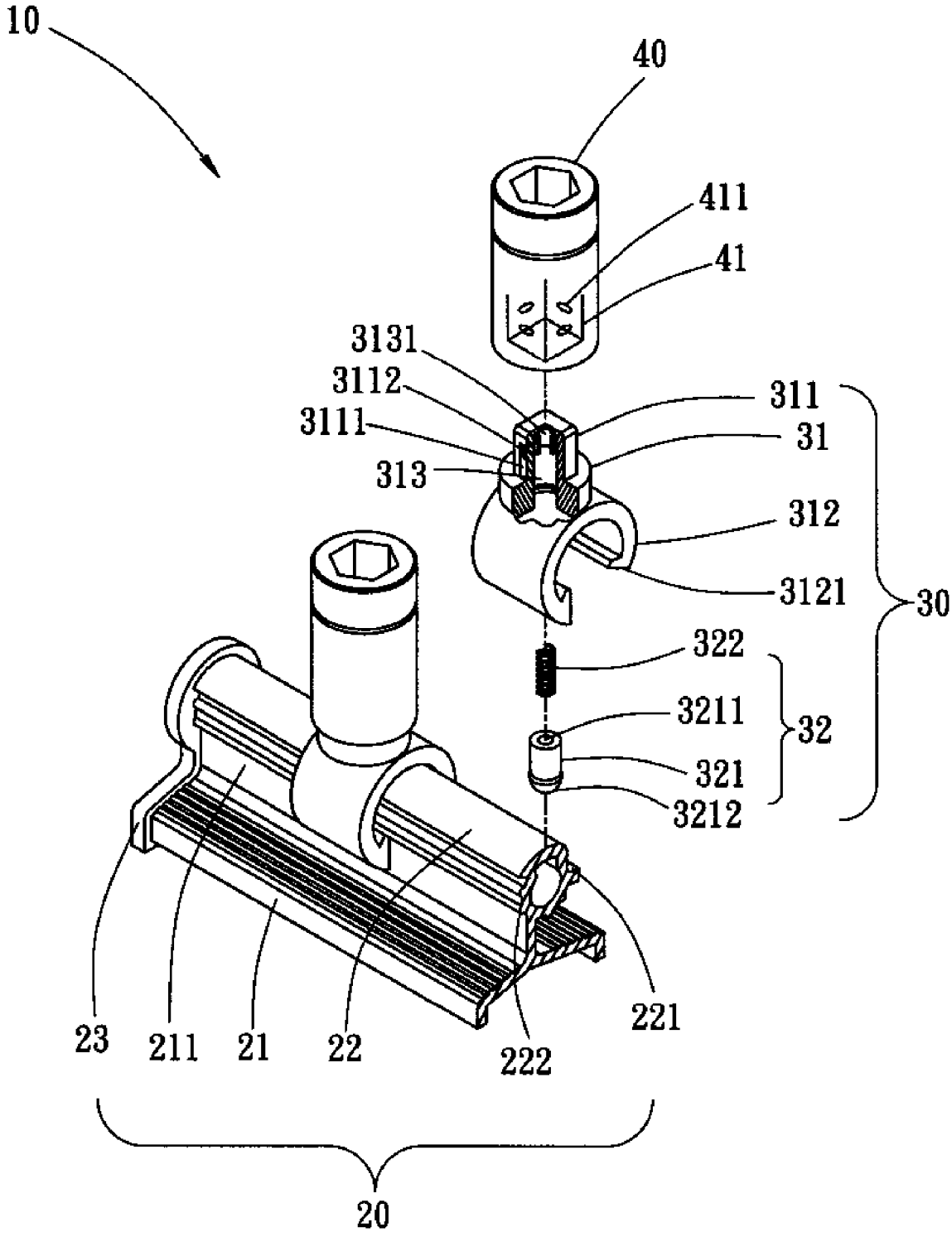
FIG. 1 is an exploded perspective view of the socket retaining assembly of the present invention.
Figure 2:
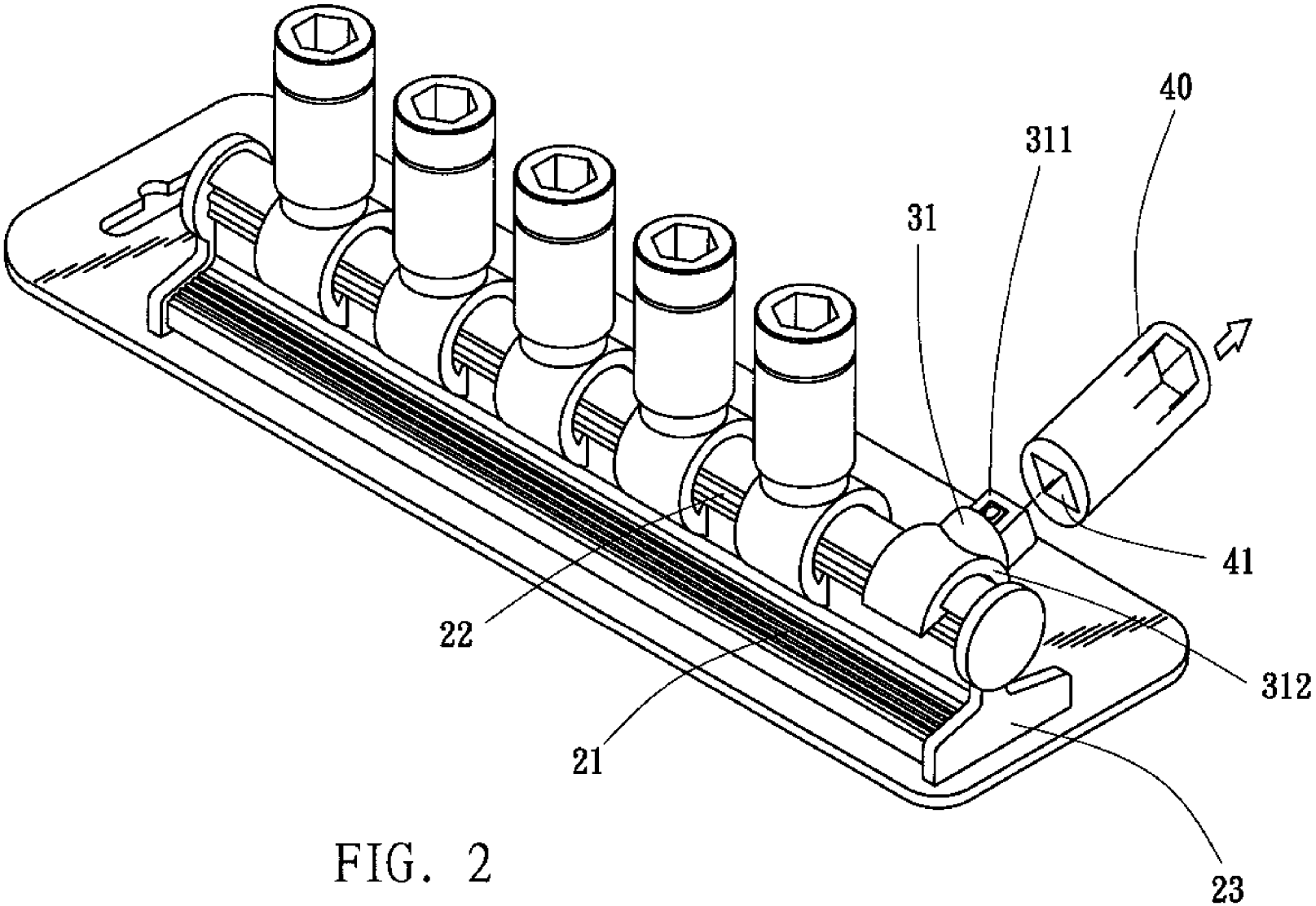
FIG. 2 is an exploded schematic view of the stopper of the present invention.

Referring to FIGS. 1 and 2, the structure of the present invention is illustrated. The present invention has the following elements.

A retaining assembly 20 has a seat 21, a retaining post 22, and two ends covers 23.

The seat 21 is a long U shape structure. A stopper 211 is protruded from an upper middle section of the seat 21. The stopper 211 is a long plate.

The retaining post 22 is installed at an upper end of the stopper 211. An outer periphery of the retaining post 22 is installed with a confining projection 221 and a plurality of trenches 222.

Each end of the retaining assembly 20 is covered by one of the two end covers 23 so as to cover the ends of the seat 21 and the retaining post 22. The end cover 23 has a shape corresponding to shapes of the ends of the retaining post 22 and the seat 21. The end covers 23 are slightly protruded from the peripheries of the retaining post 22.

The combination unit 30 includes a rotating assembly 31 and a push unit 32. The end covers 23 are slightly protruded from the peripheries of the retaining post 22 so as to confine the movement of the combination unit 30. The stopper 211 serves to confine the rotation range of the combination unit 30.

The rotating assembly 31 has a C ring 312 at a lower end thereof. Two ends of an opening of the C ring 312 are concaved inwards so as to form with inward projections 3121. In operation, the inward projections 3121 are received in the trenches 222 of the retaining post 22 and are slideably through various trenches 222 so as to adjust the combination unit 30 to have different orientation. The movement of the combination unit 30 is confined by the confining projection 221. An upper side of the C ring 312 is installed with a rectangular protruding block 311. An interior of the protruding block 311 is formed with a rectangular receiving groove 313. Two inner sides of the receiving groove 313 are installed with two resisting sheets 3111. Each resisting sheet 3111 is a rectangular sheet with one end adhered to a wall of the receiving groove 313 and other ends of the resisting sheet 3111 separates from the receiving groove 313. An upper end of the receiving groove 313 is reduced to a small fixing recess 3131. An outer periphery of the protruding block 311 is protruded with a flange 3112 for engaging a socket 40.

The combination unit 30 includes a push unit 32. The push unit 32 includes a push block 321 and an elastic unit 322. The push block 321 is a round cylinder with a convex head 3212 at a lower end thereof and a recess 3211 at an upper end thereof for receiving the elastic unit 322 so as to steadily retain the elastic unit 322. When the combination unit 30 rotates in the retaining assembly 20, the convex head 3212 will resist against the trenches 222 of the retaining post 22.

Figure 3:
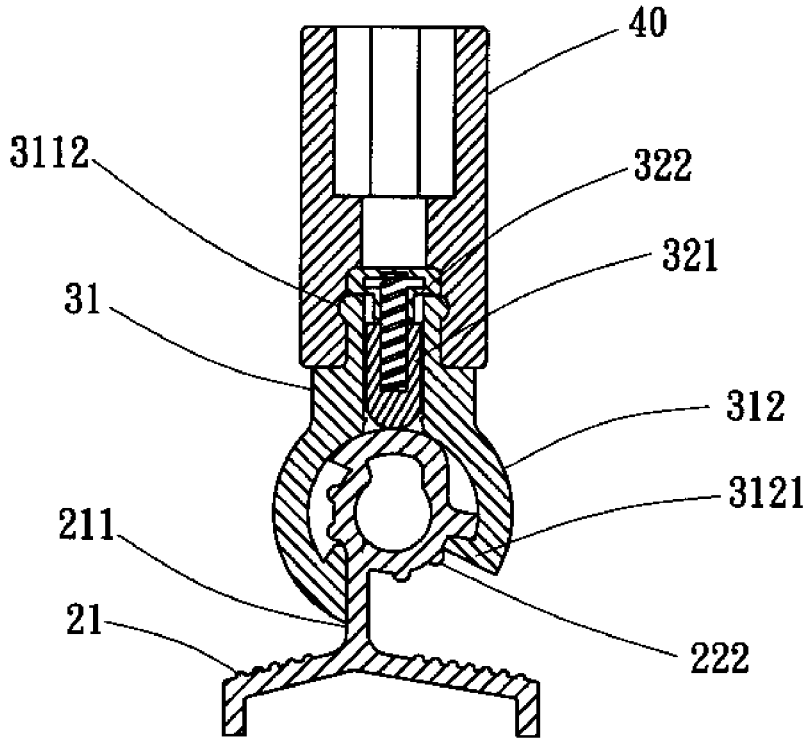
FIGS. 3 and 4 show the application of the present invention.
Figure 4:
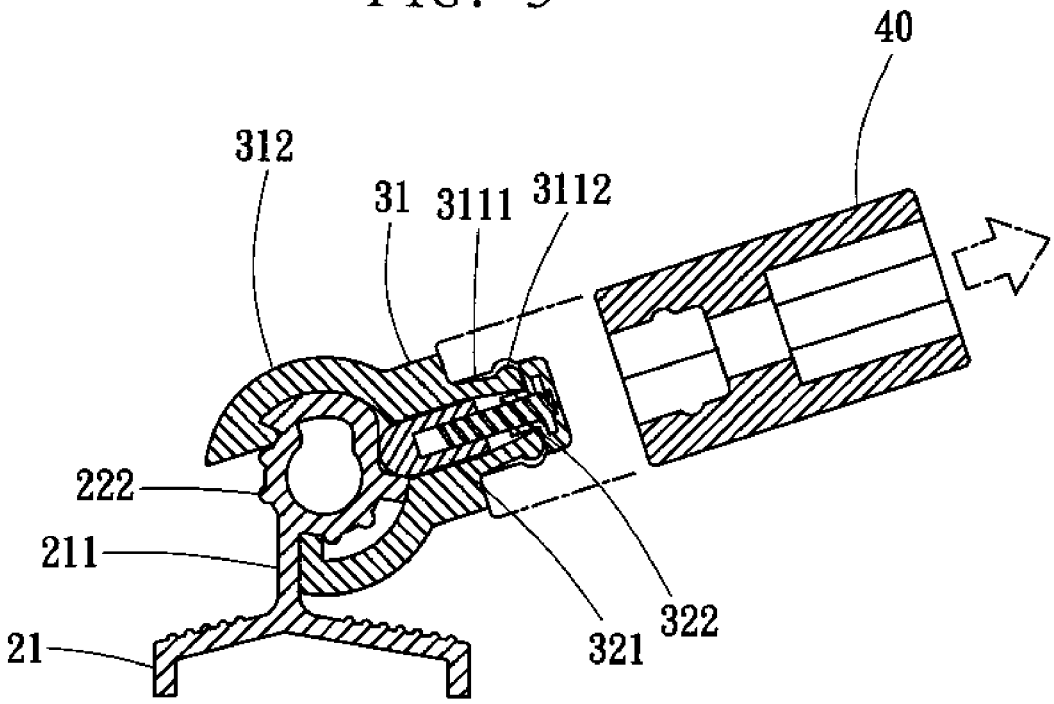

Referring to FIGS. 3 and 4, the operation of the present invention will be described herein. The prior art socket 40 has a connecting hole 41. A lower side of the connecting hole 41 is formed as a receiving space 411.

If it is desired to separate the socket 40 from the combination unit 30, it is only necessary to rotate the combination unit 30 along the retaining post 22 so that the inward projections 3121 of the C ring 312 will engage to different trenches 322 of the retaining post 22, see FIGS. 3 and 4. Referring to FIG. 4, when the combination unit 30 rotates to an orientation which make the C ring 312 expand, while in the other end, the protruding block 311 will reduce inwards so that the flange 3112 separates from an inner recess of the socket 40 and thus the socket 40 can separate from the combination unit 30.

Referring to FIG. 2, a plurality of combination units 30 are different to the retaining post 22.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A socket retaining assembly comprising:

a retaining assembly having a seat, and a retaining post;

the seat being an approximate U shape structure; a stopper being protruded from an upper middle section of the seat; the stopper being a long plate;

the retaining post being installed at an upper end of the stopper; an outer periphery of the retaining post being formed with a confining projection and a plurality of trenches;

at least one combination unit including a rotating assembly and a push unit; the stopper serving to confine the rotation range of the combination unit;

the rotating assembly having a C ring at a lower end thereof; two ends of an opening of the C ring being concaved inwards so as to form with inward projections; in operation, the inward projections being received in the trenches of the retaining post and being slideably through various trenches so as to adjust the combination unit to have different orientation; the movement of the combination unit being confined by the confining projection; an upper side of the C ring being installed with a rectangular protruding block; an interior of the protruding block being formed with a rectangular receiving groove;

the push unit being installed in the receiving groove of the protruding block;

wherein when the combination unit rotates along the retaining assembly, the push unit will resist against the trenches of the retaining post.

2. The socket retaining assembly as claimed in claim 1, further comprising two ends covers; each end of the retaining assembly is covered by one of the two end covers so as to cover the ends of the seat and the retaining post; the end cover has a shape corresponding to shapes of the ends of the retaining post and the seat; the end cover are slightly protruded from the peripheries of the retaining post so as to confine the movement of the combination unit.

3. The socket retaining assembly as claimed in claim 1, wherein two inner sides of the receiving groove are installed with two resisting sheets; each resisting sheet is a rectangular sheet with one end adhered to a wall of the receiving groove and other ends of the resisting sheet separate from the receiving groove.

4. The socket retaining assembly as claimed in claim 1, wherein an upper end of the receiving groove is reduced to a small fixing recess.

5. The socket retaining assembly as claimed in claim 1, wherein the push unit includes a push block and an elastic unit.

6. The socket retaining assembly as claimed in claim 5, wherein the push block is a round cylinder with a convex head at a lower end thereof and a recess is formed at an upper end thereof for receiving the elastic unit so as to steadily retain the elastic unit; when the combination unit 30 rotates in the retaining assembly, the convex head will resist against the trenches of the retaining post.

7. The socket retaining assembly as claimed in claim 6, wherein the elastic unit is a spring.

8. The socket retaining assembly as claimed in claim 1, wherein an outer periphery of the protruding block is protruded with a flange for engaging a socket.

* * * * *